US009061529B2

(12) United States Patent
Fuchioka et al.

(10) Patent No.: US 9,061,529 B2
(45) Date of Patent: Jun. 23, 2015

(54) PRINTING APPARATUS

(71) Applicant: Dainippon Screen Mfg. Co., Ltd., Kyoto-Shi (JP)

(72) Inventors: Hiroyuki Fuchioka, Kyoto (JP); Shinsuke Yamashita, Kyoto (JP); Tsuyoshi Okuda, Kyoto (JP)

(73) Assignees: SCREEN HOLDINGS CO., LTD., Kyoto (JP); Ricoh Company, Ltd., Tokyo (JP)

( * ) Notice: Subject to any disclaimer, the term of this patent is extended or adjusted under 35 U.S.C. 154(b) by 227 days.

(21) Appl. No.: 13/854,735

(22) Filed: Apr. 1, 2013

(65) Prior Publication Data

US 2013/0258021 A1 Oct. 3, 2013

(30) Foreign Application Priority Data

Mar. 30, 2012 (JP) ..... 2012-081274

(51) Int. Cl.
*B41J 11/00* (2006.01)
*B41J 3/54* (2006.01)
*B41J 15/04* (2006.01)

(52) U.S. Cl.
CPC ..... *B41J 11/007* (2013.01); *B41J 3/543* (2013.01); *B41J 15/04* (2013.01); *B41J 15/048* (2013.01)

(58) Field of Classification Search
CPC ..... B41J 11/00; B65H 39/10; B65H 28/68
USPC ..... 347/104; 271/298, 204, 183
See application file for complete search history.

(56) References Cited

U.S. PATENT DOCUMENTS

| | | | | |
|---|---|---|---|---|
| 6,241,238 | B1 | 6/2001 | Aoki | |
| 6,782,822 | B2 * | 8/2004 | Verhoest et al. | 101/424.1 |
| 7,374,280 | B2 * | 5/2008 | Kusunoki | 347/102 |
| 7,377,632 | B2 * | 5/2008 | Kachi | 347/102 |
| 7,422,318 | B2 * | 9/2008 | Kadomatsu et al. | 347/102 |
| 7,458,672 | B2 * | 12/2008 | Hirakawa | 347/101 |
| 7,469,999 | B2 * | 12/2008 | Kadomatsu et al. | 347/55 |
| 7,510,277 | B2 * | 3/2009 | Konno et al. | 347/102 |

(Continued)

FOREIGN PATENT DOCUMENTS

| | | |
|---|---|---|
| CN | 2621918 Y | 6/2004 |
| CN | 1572487 A | 2/2005 |

(Continued)

OTHER PUBLICATIONS

Chinese Office Action dated Jan. 20, 2015 issued in corresponding Chinese Patent Application No. 201310063997.

*Primary Examiner* — Alessandro Amari
*Assistant Examiner* — Alexander C Witkowski
(74) *Attorney, Agent, or Firm* — McDermott Will & Emery LLP

(57) ABSTRACT

Each unit of an inkjet printing station includes chains arranged along a transportation path of a web paper. A holding mechanism is fixedly arranged on the chain. The holding mechanism holds both ends of a paper passing bar to which the web paper is attached. Driving the chain with a handle causes the holding mechanism to move. The paper passing bar is delivered between the units adjoining each other. Therefore, the paper passing bar is movable from one end to the other end of the inkjet printing station formed by the units. Moreover, when specifications are changed for changing combination of the units, the combination can be made optionally.

20 Claims, 6 Drawing Sheets

(56) References Cited

U.S. PATENT DOCUMENTS

| | | | | |
|---|---|---|---|---|
| 7,597,438 | B2 * | 10/2009 | Konno et al. | 347/102 |
| 7,607,773 | B2 * | 10/2009 | Nagashima | 347/102 |
| 7,614,712 | B2 * | 11/2009 | Kachi | 347/14 |
| 7,628,481 | B2 * | 12/2009 | Kadomatsu et al. | 347/102 |
| 7,651,212 | B2 * | 1/2010 | Kadomatsu et al. | 347/102 |
| 7,651,213 | B2 * | 1/2010 | Konno et al. | 347/102 |
| 7,658,489 | B2 * | 2/2010 | Yamanobe | 347/102 |
| 7,712,887 | B2 * | 5/2010 | Kadomatsu et al. | 347/102 |
| 7,712,889 | B2 * | 5/2010 | Inoue | 347/102 |
| 7,717,551 | B2 * | 5/2010 | Kadomatsu et al. | 347/102 |
| 7,731,324 | B2 * | 6/2010 | Nagashima | 347/19 |
| 7,766,440 | B2 * | 8/2010 | Kusunoki | 347/14 |
| 7,789,503 | B2 * | 9/2010 | Kusunoki | 347/102 |
| 7,845,786 | B2 * | 12/2010 | Konno | 347/102 |
| 7,914,108 | B2 * | 3/2011 | Konno et al. | 347/21 |
| 8,070,283 | B2 * | 12/2011 | Kusunoki | 347/102 |
| 8,317,315 | B2 * | 11/2012 | Hoover et al. | 347/104 |
| 8,567,938 | B2 * | 10/2013 | Tombs et al. | 347/102 |
| 8,628,188 | B2 * | 1/2014 | Tokisawa et al. | 347/102 |
| 8,672,467 | B2 * | 3/2014 | Yamanobe | 347/102 |
| 8,684,510 | B2 * | 4/2014 | Miyamoto et al. | 347/102 |
| 8,690,312 | B2 * | 4/2014 | Tombs et al. | 347/102 |
| 8,721,065 | B2 * | 5/2014 | Ishitoya et al. | 347/104 |
| 8,777,394 | B2 * | 7/2014 | Tombs et al. | 347/102 |
| 8,780,147 | B2 * | 7/2014 | Tombs et al. | 347/112 |
| 2005/0006840 | A1 | 1/2005 | Kusaka | |
| 2005/0185040 | A1 * | 8/2005 | Nagashima | 347/102 |
| 2005/0190248 | A1 * | 9/2005 | Konno et al. | 347/102 |
| 2005/0200676 | A1 * | 9/2005 | Kadomatsu et al. | 347/102 |
| 2005/0219342 | A1 * | 10/2005 | Kachi | 347/102 |
| 2006/0033794 | A1 * | 2/2006 | Yamanobe | 347/102 |
| 2006/0061625 | A1 * | 3/2006 | Konno et al. | 347/55 |
| 2006/0066703 | A1 * | 3/2006 | Kadomatsu et al. | 347/102 |
| 2006/0164487 | A1 * | 7/2006 | Kadomatsu et al. | 347/102 |
| 2006/0238592 | A1 * | 10/2006 | Kadomatsu et al. | 347/102 |
| 2007/0013759 | A1 * | 1/2007 | Kadomatsu et al. | 347/102 |
| 2007/0024686 | A1 * | 2/2007 | Kadomatsu et al. | 347/102 |
| 2007/0040885 | A1 * | 2/2007 | Kusunoki | 347/102 |
| 2007/0058021 | A1 * | 3/2007 | Kusunoki | 347/102 |
| 2007/0064077 | A1 * | 3/2007 | Konno | 347/102 |
| 2009/0085997 | A1 * | 4/2009 | Sakamoto | 347/102 |
| 2010/0271449 | A1 * | 10/2010 | Kusunoki | 347/102 |
| 2011/0228025 | A1 * | 9/2011 | Miyamoto et al. | 347/102 |
| 2011/0234724 | A1 * | 9/2011 | Hoover et al. | 347/102 |
| 2011/0261102 | A1 * | 10/2011 | Kurasawa et al. | 347/16 |
| 2011/0261128 | A1 * | 10/2011 | Tokisawa et al. | 347/102 |
| 2012/0176437 | A1 * | 7/2012 | Usuda | 347/16 |
| 2013/0076844 | A1 * | 3/2013 | Tombs et al. | 347/102 |
| 2013/0100219 | A1 * | 4/2013 | Tokisawa et al. | 347/102 |
| 2013/0127962 | A1 * | 5/2013 | Yoda | 347/102 |
| 2013/0135378 | A1 * | 5/2013 | Tanjo et al. | 347/16 |
| 2013/0135379 | A1 * | 5/2013 | Hori et al. | 347/16 |
| 2013/0135407 | A1 * | 5/2013 | Abe | 347/102 |
| 2014/0375737 | A1 * | 12/2014 | Van Beek et al. | 347/102 |

FOREIGN PATENT DOCUMENTS

| | | | |
|---|---|---|---|
| CN | 2770969 | Y | 4/2006 |
| CN | 201338417 | Y | 11/2009 |
| JP | 61-257854 | A | 11/1986 |
| JP | 06-191690 | A | 7/1994 |
| JP | 2000-095408 | A | 4/2000 |
| JP | 3607906 | B2 | 1/2005 |

* cited by examiner

PRINTING APPARATUS

BACKGROUND OF THE INVENTION

1. Field of the Invention

This invention relates to a printing apparatus for performing printing on a print medium supplied from a roll of the print medium.

2. Description of the Related Art

Examples of such apparatus as above conventionally include an inkjet printing apparatus. The inkjet apparatus includes an inkjet printing station, a paper feeder, and a take-up roller. The inkjet printing station performs printing on a print medium (e.g., a web paper). The paper feeder holds a roll of the print medium, unwinds the print medium from the roll of print medium, and supplies the print medium to the inkjet printing station. The take-up roller winds up the printed print medium into a roll form. The inkjet printing station includes an inkjet heads for discharging ink droplets to the print medium, and a mechanism for moving the inkjet heads and the print medium relatively to each other.

Moreover, Japanese Patent Publication No. S61-257854 discloses a paper passing device in a web supply apparatus. The paper passing device supplies a paper fed out from an upper web-supply roll (a roll of an upper print medium) and a lower web-supply roll alternately. The paper passing device includes guide rails. A roller chain (hereinafter, referred to as a "chain") is inserted into a gap between the guide rails. When an electric motor having a chain pulley (sprocket) being fitted therewith rotates, the chain moves along the guide rails, whereby a web transport bar for passing paper is moved.

However, the conventional inkjet printing apparatus has the following drawbacks. That is, the print medium is transported within the inkjet printing apparatus when the print medium is replaced or firstly subject to setting (also referred to as "loading"). The print medium is transported by putting hands of an operator into the inkjet printing apparatus along a transportation path of the print medium. Accordingly, this operation needs an experiential technique, time, and the like. For instance, the print medium provided with perforations or the thin print medium may tear. Thus, this operation is not easy for the operator. Such a drawback may arise.

The inkjet printing apparatus enables to support changes in specification. Specifically, the inkjet printing station except for the paper feeder and the take-up roller is divided depending on functions, and thus is formed by two or more units. For instance, the inkjet printing station includes three units, i.e., a print unit, a unit disposed upstream of the print unit, and a unit disposed downstream of the print unit. Moreover, the print unit performs four-color printing of, for example, KCMY (black, cyanogen, magenta, and yellow). When the print unit performs four-color printing, for example, with high definition, the print unit is upsized. Accordingly, the print unit is divided into two print units each having inkjet heads placed therein. In this case, one original print unit is replaced with two print units. Moreover, six-color printing is occasionally needed by adding a print unit of two-color (orange, green) printing to the print unit of four color prints.

As noted above, specifications of the inkjet printing apparatus can be changed by combining a plurality of units optionally. However, where the paper passing mechanism for transporting the print medium is adopted in the inkjet printing apparatus, the mechanism should be changed in accordance with combination of a plurality of units. Therefore, it was difficult to achieve a balance between adoption of the mechanism for transporting the paper and optical combination of a plurality of units.

SUMMARY OF THE INVENTION

Additional features of the invention will be set forth in the description which follows, and in part will be apparent from the description, or may be learned by practice of the invention.

This invention has been made regarding the state of the art noted above, and its object is to provide an inkjet printing apparatus that allows ready setting of a print medium and optional combination of two or more units.

This invention is constituted as stated below to achieve the above object. This invention discloses a printing apparatus for performing printing to a print medium supplied from a roll of the print medium. The apparatus includes two or more units formed by dividing a printing apparatus body depending on functions; an endless belt provided for each of the two or more units and disposed along a transportation path of the print medium; a holding mechanism fixedly arranged on the endless belt for holding both ends of an attachment bar to which the print medium is attached; and an endless-belt driving mechanism for driving the endless belt, the two or more units delivering the attachment bar between the units adjoining each other.

In the printing apparatus according to one aspect of this invention, the endless belt is disposed in each of the two or more units along the transportation path of the print medium, the units being formed by dividing the printing apparatus body depending on functions. The holding mechanism is fixedly arranged on the endless belt, the holding mechanism holding both ends of the attachment bar to which the print medium is attached. As the endless-belt driving mechanism drives the endless belt, the holding mechanism enables to move while being guided with the endless belt. The attachment bar is delivered between the units among the two or more units adjoining each other. Therefore, the attachment bar is movable from one end to the other end of the printing apparatus body formed by the two or more units. This achieves readily setting of the print medium. Moreover, when specifications are changed for changing combination of the two or more units, the combination can be made optionally.

Moreover, the holding mechanism in the printing apparatus mentioned above preferably includes a recess for holding the both ends of the attachment bar. Accordingly, the both ends of an attachment bar can be housed and held in the recess.

Moreover, the recess in the printing apparatus mentioned above preferably includes a locking mechanism for preventing the attachment bar from dropping off. Accordingly, when the attachment bar is delivered among the two or more units, dropping off the attachment bar held in the recess can be eliminated.

Moreover, the printing apparatus mentioned above preferably includes an attitude changing section. The attitude changing section enables to change an attitude of the recess into an attitude for delivering the attachment bar by rotation of the recess, the recess being rotatable relative to an axis of the attachment bar. Accordingly, the attachment bar enables to be delivered smoothly with the recess.

Moreover, the two or more units in one aspect of the printing apparatus mentioned above deliver the attachment bar via a delivering section between the units adjoining each other. Since the attachment bar placed on the delivering section is delivered, the attachment bar can be delivered with more ease than the case when the attachment bar is directly delivered. In addition, the delivering section enables to prevent the attachment bar from failing to be delivered to be guided to and beyond the endless belt.

Moreover, in one aspect of the printing apparatus mentioned above, the attachment bar is directly delivered via the holding mechanisms between the units adjoining each other. No delivering section is provided, resulting in an effect due to no delivering section such as obtaining a usable space where the delivering section is to be placed originally.

It is preferable that the printing apparatus mentioned above further includes a movement detecting section for detecting movement of the endless belt; a drive roller for transporting the print medium; and a drive controller for driving the drive roller in accordance with the movement detected by the movement detecting section. As the endless-belt driving mechanism drives the endless belt, the movement detecting section detects the movement of the endless belt. The drive controller drives the drive roller in accordance with the movement detected by the movement detecting section. Accordingly, load due to friction generated between the print medium and the drive roller can be reduced upon passing the paper. Therefore, driving torque of the endless-belt driving mechanism for driving the endless belt can be reduced. In addition, tearing the paper of the print medium can be eliminated.

Moreover, the printing apparatus mentioned above preferably includes a permission switch for permitting drive of the drive roller. The drive controller drives the drive roller in accordance with the movement detected by the movement detecting section. The permission switch enables to prevent the drive roller from driving unexpectedly, resulting in safe paper passing by the operator.

It is to be understood that both the foregoing general description and the following detailed description are exemplary and explanatory and are intended to provide further explanation of the invention as claimed.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
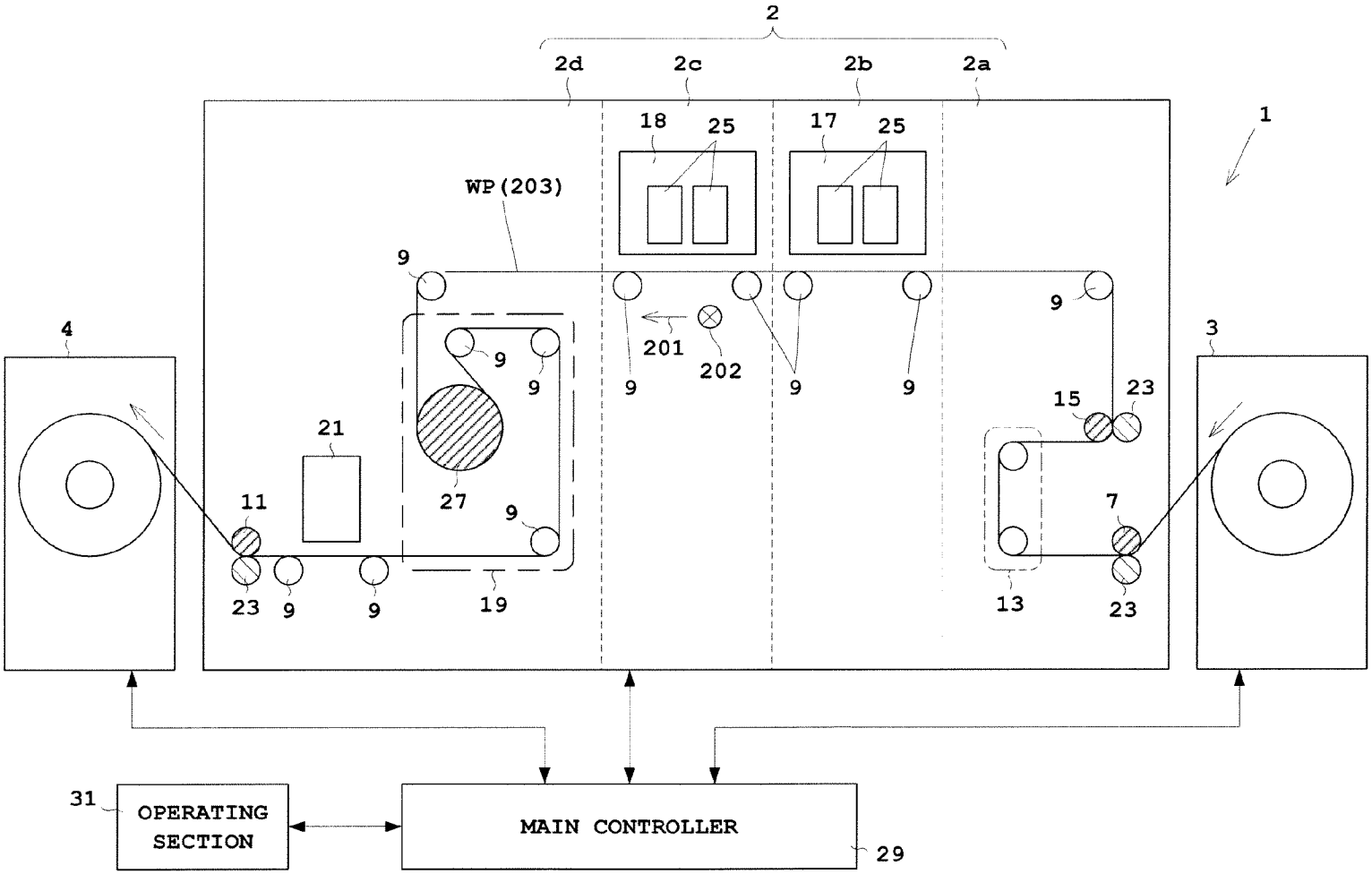
FIG. 1 is a schematic view illustrating an outline of an inkjet printing apparatus according to one example of this invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

Preferred examples of this invention will be described in detail hereinafter with reference to the drawings.

EXAMPLE 1

Figure 2:
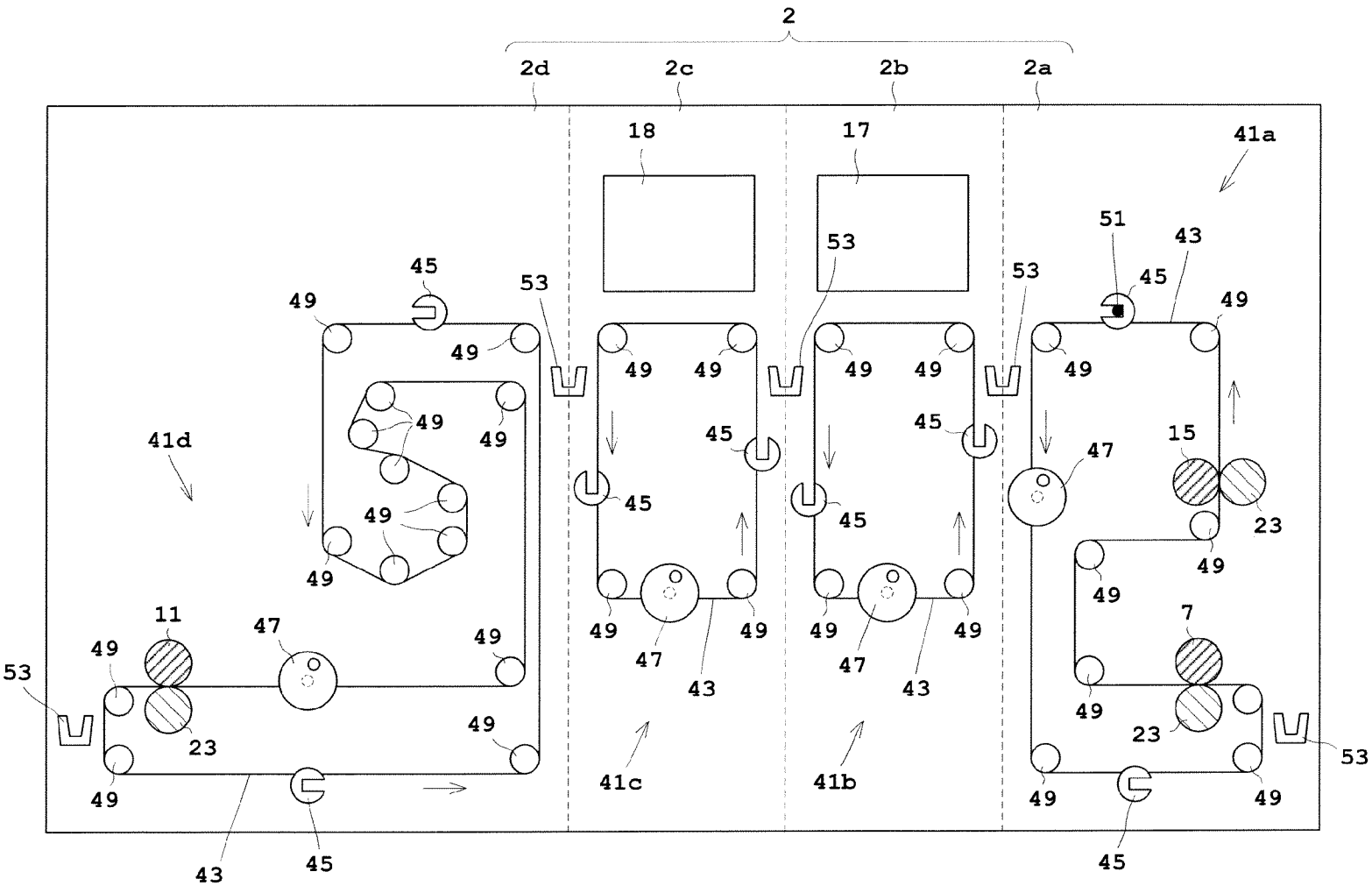
FIG. 2 is a schematic view illustrating an outline of a paper passing mechanism in an inkjet printing station according to the example of this invention.
Figure 3:
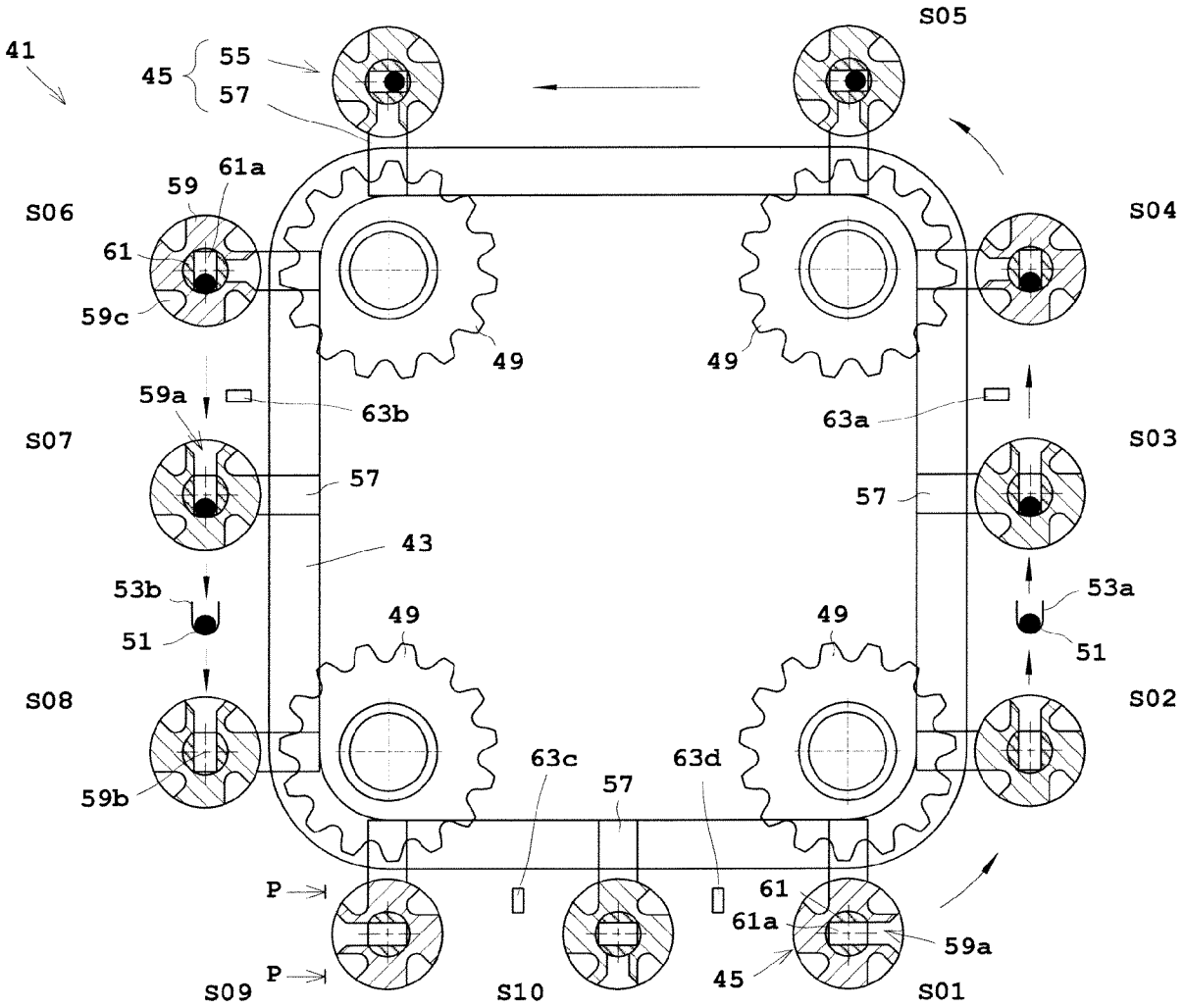
FIG. 3 is a conceptual view illustrating the paper passing mechanism according to the example of this invention.
Figure 4:
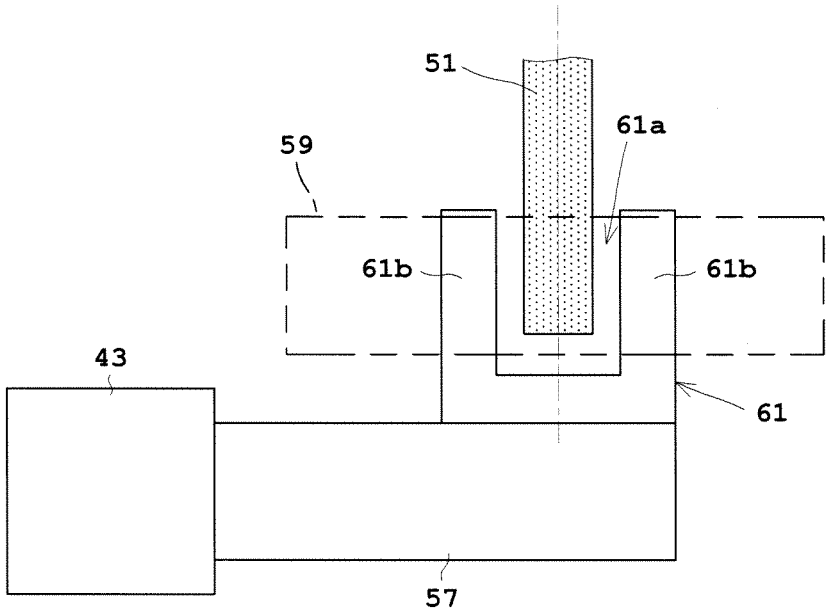
FIG. 4 illustrates a rotating element supporter.

Example 1 of the invention will be described hereinafter with reference to the drawings. FIG. 1 is a schematic view illustrating an outline of an inkjet printing apparatus according to Example 1. FIG. 2 is a schematic view illustrating an outline of a paper passing mechanism in an inkjet printing station according to Example 1. FIG. 3 is a conceptual view illustrating the paper passing mechanism according to Example 1. FIG. 4 illustrates a rotating element supporter.

Reference is now made to FIG. 1. An inkjet apparatus 1 includes an inkjet printing station 2, a paper feeder 3, and a take-up roller 4. The inkjet printing station 2 performs printing on a sheet web paper WP. The paper feeder 3 feeds the web paper WP to the inkjet printing station 2. The take-up roller 4 winds up the printed web paper WP into a roll form. Here, the web paper WP corresponds to the print medium in this invention. The inkjet printing station 2 corresponds to the printing apparatus body in this invention.

The paper feeder 3 holds a roll of the web paper WP so as to be rotatable about a horizontal axis, and unwinds the web paper WP from the roll of the web paper WP to feed the web paper WP to the inkjet printing station 2. The take-up roller 4 winds up the web paper WP printed by the inkjet printing station 2 about the horizontal axis. Regarding the side from which the web paper WP is fed as upstream and the side to which the web paper WP is taken up as downstream, the paper feeder 3 is disposed upstream of the inkjet printing station 2 while the take-up roller 4 is disposed downstream of the inkjet printing station 2.

The inkjet printing station 2 includes a drive roller 7 in an upstream position thereof for taking in the web paper WP from the paper feeder 3. The web paper WP unwound from the paper feeder 3 by the drive roller 7 is transported downstream toward the take-up roller 4 along rotatable transport rollers 9 having no drive mechanism. A drive roller 11 is disposed between an inspecting section 21, to be mentioned later, and the take-up roller 4. The drive roller 11 feeds the web paper WP passing through the inspecting section 21, to be mentioned later, toward the take-up roller 4.

The inkjet printing station 2 is divided into two or more units depending on functions. In this example, the inkjet printing station 2 is formed by four units 2*a* to 2*d*. A first unit 2*a* includes the drive roller 7, an edge-position controller 13, and a drive roller 15, and the like. A second unit 2*b* includes a print unit 17. A third unit 2*b* includes a print unit 18. A fourth unit 2*d* includes a drying section 19, an inspecting unit 21, a drive roller 11, and the like. In this example, the inkjet printing station 2 is divided into the four units 2*a* to 2*d*. However, this is not limitative. For instance, the fourth unit 2*d* may be formed by two units, i.e., one unit of the drying section 19, and one unit of the inspecting section 21 and the drive roller 11.

The web paper WP is transported to the drive roller 7, the edge-position controller 13, the drive roller 15, the print unit 17, the drying section 19, the inspecting section 21, and the drive roller 11 in this order. A transportation path of the web paper WP is denoted by the symbol 203. When the web paper WP serpentines, the edge-position controller 13 automatically adjusts the web paper WP to transport the web paper WP into a correct position. The drive roller 15 rotates at a fixed speed. The speed corresponds to a reference speed of rotation of other drive rollers 7 and 11 and a heat drum 27 to be mentioned later.

Each of the drive rollers 7, 11, and 15 is provided with a rotatable nip roller 23. The nip roller 23 presses the drive rollers 7, 11, and 15 across the web paper WP, thereby applying a transportation force of the web paper WP. Pressure is applied by an air cylinder, for example. The rip roller 23 is composed of an elastic body such as rubber.

The print units 17 and 18 each have inkjet heads 25 for discharging ink droplets. The print units 17 and 18 each have two or more inkjet heads 25. The inkjet heads 25 are formed in a staggered arrangement in a width direction (primary scanning direction) 202 of the web paper WP orthogonal to a transportation direction (secondary scanning direction) 201 of the web paper WP. Consequently, ink droplets are discharged to the web paper WP while the web paper WP is transported while a position thereof is fixed without moving the web paper WP in the width direction 202. Hereinunder, description will be given of the two or more inkjet heads 25 formed in the width direction 202 in the staggered arrangement as one inkjet head 25.

In this example, the inkjet printing station 2 includes the two print units 17 and 18. For instance, in order to achieve four-color printing with high definition, the print units 17 and 18 each include inkjet heads 25 of 2 colors. For instance, the print unit 17 includes the inkjet heads 25 of black (K) and cyan (C), whereas the print unit 18 includes the inkjet heads 25 of magenta (M) and yellow (Y). The four inkjet heads 25 of KCMY colors are placed in the transportation direction 201 of the web paper WP. The print units 17 and 18 are connected to an ink supply section, not shown, for supplying ink droplets to the print unit 17 and 18 as required.

The print units 17 and 18 may perform six-color printing, for example. In this case, the print unit 17 includes four inkjet heads 25 of KCMY, whereas the print unit 18 includes two inkjet heads 25 of orange and green.

The drying section 19 dries the ink droplets discharged from the inkjet heads 25 and adhered to the web paper WP. The drying section 19 includes a heat drum 27. The heat drum 27 contains a heater and rotates. The inspecting unit 21 inspects the printed portions for any stains or omissions. The take-up roller 4 winds up the inspected web paper WP in a roll form.

The inkjet printing apparatus 1 includes a main controller 29 and an operating section 31. The main controller 29 controls en bloc each element of the inkjet printing apparatus 1. The main controller 29 is formed of a central processing unit (CPU) and others. The operating section 31 operates the inkjet printing apparatus 1. The operating section 31 is formed of a touch panel, various switches and others. The operating section 31 also includes a personal computer that may input operations via a mouse, a keyboard, and the like. The drive rollers 7, 11, and 15 and the heat drum 27 are rotated with a drive mechanism, not shown, such as a motor and a gear.

[Paper Passing Mechanism]

Reference is now made to FIG. 2. The inkjet printing station 2 is formed by the four units 2*a* to 2*d*. The four units 2*a* to 2*d* have paper passing mechanisms 41*a* to 41*d*, respectively. Hereinunder, the paper passing mechanisms 41*a* to 41*d* are described as a paper passing mechanism 41 in general. The paper passing mechanism 41 includes a chain 43, a holding mechanism 45, and a handle 47. Here, the chain 43 corresponds to the endless belt in this invention. The handle 47 corresponds to the endless-belt driving mechanism in this invention.

The chains 43 are provided for different four units 2*a* to 2*d* along the transportation path 203 of the web paper WP. For instance, in the first unit 2*a*, the chain 43 is arranged on the drive roller 7, the edge-position controller 13, and the drive roller 15, in this order, along the transportation path 203 (FIG. 1) of the web paper WP. Then the chain 43 is arranged so as to travel adjacent to the second unit 2*b*. Thereafter, the chain 43 is arranged so as to pass through the drive roller 7 again. That is, the chain 43 circulates.

The chain 43 engages with a sprocket 49. The sprocket 49 rotates with no driving mechanism. The sprocket 49 is provided such that the chain 43 can travel on any path. The two chains 43 are provided in the depth direction on the plane of FIG. 2.

The holding mechanism 45 is fixed on the chain 43 and holds both ends of a paper passing bar 51 to which the web paper WP is attached. The holding mechanism 45 moves as the chain 45 drives. One or more holding mechanisms 45 are provided in each of the four units 2*a* to 2*d*. The holding mechanisms 45 are provided in each of the chains 43 arranged in the depth direction on the plane of FIG. 2. The paper passing bar 51 is formed of a long bar. The end of the web paper WP is attached to the paper passing bar 51 via an adhesive tape, an attachment jig, and the like. The holding mechanism 45 is located outside of the web paper WP attached to the paper passing bar 51 and holds the paper passing bar 51 around the both ends thereof. Here, the paper passing bar 51 corresponds to the attachment bar in this invention.

The handle 47 drives the chain 43. The handle 47 has a fixed shaft at a tip end thereof. The shaft includes a sprocket fixed thereon so as to engage with the two chains 43 arranged in the depth direction on the plane of FIG. 2. See FIG. 5A to be mentioned later. Here, rotation by the handle 47 may be transmitted to the chains 43 via a gear mechanism.

Delivering sections 53 are each provided between the first unit 2*a* and the second unit 2*b*, between the second unit 2*b* and the third unit 2*c*, and between the third unit 2*c* and the fourth unit 2*d*. Moreover, delivering sections 53 are each provided in an inlet (paper feeding) side of the web paper WP in the first unit 2*a* and in an outlet (paper taking-up) side of the web paper WP in the fourth unit 2*d*. The paper passing bar 51 is delivered between the adjoining units among the first to fourth units 2*a* to 2*d* via the delivery sections 53. Specifically, the delivery section 53 delivers the paper passing bar 51 between the adjoining units (for example, between the first unit 2*a* and the second unit 2*b*). Two or more terneplates 63, mentioned later and not shown in FIG. 2, are arranged at any positions along the chains 43.

Reference is now made to FIG. 3. FIG. 3 is a conceptual view of a paper passing mechanism 41. The holding mechanism 45 includes a recess 55 for holding both ends of the paper passing bar 51, and a recess supporter 57 for supporting the recess 55. The recess 55 includes a rotating element 59 that enables to rotate relative to the axis of the paper passing bar 51, and a rotating-element supporter 61 for rotatably supporting the rotating element 59. The rotating-element supporter 61 is fixed on the recess supporter 57. The handle 47 is not illustrated in FIG. 3. The handle 47 drives the chains 43 at any positions determined in advance.

The rotating element 59 has an opening 59*a* for holding the paper passing bar 51. The rotating-element supporter 61 penetrates a section orthogonal to a rotation center 59*b* of the rotating element 59 in one direction. The rotating-element supporter 61 has a housing part 61*a* for housing the paper passing bar 51. FIG. 4 illustrates the rotating element supporter 61 seen from a P-direction in FIG. 3. The top of the rotating element supporter 61 is divided into two parts. That is, the top of the rotating element supporter 61 is bifurcated (in a Y-shape). The housing part 61*a* is provided between two divided portions 61*b* of the rotating element supporter 61. The rotating element supporter 61 may be form by two separated members as required.

Reference is made again to FIG. 3. When the opening 59*a* of the rotating element 59 is communicated with the housing part 61*a* of the rotating element supporter 61, the paper passing bar 51 can be housed into the housing part 61*a*. That is, the recess 55 can house and hold the both ends of the paper passing bar 51.

When the rotating element 59 rotates while the paper passing bar 51 is housed into the housing part 61*a*, the opening of the rotating element 59 rotates. Therefore, the opening 59*a* is not brought into communication with the housing part 61*a*. Accordingly, the holding mechanism 45 enables to prevent the paper passing bar 51 held in the recess 55 from dropping off when the paper passing par 51 is delivered among the four units 2*a* to 2*d*.

The rotating element 59 includes notches 59*c*. For instance, four notches 59*c* are arranged at intervals of 90 degrees relative to the rotation center 59*b* of the rotating element 59. The rotating element 59 is provided with a spring member, such as a ball plunger, so as to stop at rotating positions set in advance at intervals of 90 degrees, for example. Moreover, a terneplate (terne member) 63 for rotating the rotating element 59 is provided along the chain 43. The rotating element 59 rotates by 90 degrees each time the holding mechanism 45 passes through the terneplate 63. Two or more (e.g., four) terneplates are provided at positions set in advance along the chain 43 so as to change an attitude of the rotating element 59 into an attitude for delivering the paper passing bar 51 upon delivering the paper passing bar 51. Here, the rotating element 59 and the rotating element supporter 61 correspond to the locking mechanism in this invention. The notch 59*c* and the terneplate 63 correspond to the attitude changing section in this invention.

Description will be given next of operations of the paper passing mechanism 41 with reference to FIG. 3. In FIG. 3, it is assumed that the chain 43 turns counterclockwise and the holding mechanism 45 fixed on the chain 43 also turns counterclockwise. The delivering section 53 for delivering the paper passing bar 51 from the unit disposed upstream is to be described as a first delivery section 53*a*. The delivering section 53 for delivering the paper passing bar 51 to the unit disposed downstream is to be described as a second delivery section 53*b*. The terneplates 63 are assumed to be placed at four positions along the chain 43. The terneplates 63 are to be described as first to fourth terneplates 63*a* to 63*d*. Moreover, it is assumed that the end of the web paper WP is attached to the paper passing bar 51 via an adhesive tape, an attachment jig, and the like.

[Step S01]

It is assumed that the holding mechanism 45 is placed in front of the first delivery section 53*a*. At this time, the holding mechanism 45 moves horizontally. The opening 59*a* of the rotating element 59 is directed in a travelling direction, i.e., rightward on the plane of FIG. 3. Moreover, the opening 59*a* of the rotating element 59 is in communication with the housing part 61*a* of the rotating element supporter 61.

[Step S02]

An operator rotates the handle 47 (FIG. 2). Rotating the handle 47 causes the chain 43 to drive. At this time, the holding mechanism 45 moves vertically, and the opening 59*a* of the rotating element 59 is directed upward on the plane. In steps subsequent to step S3, driving force due to rotation of the handle 47 is applied to the chain 43.

[Step S03]

The recess 55 of the holding member 45 receives the paper passing bar 51 upon passing through the first delivery section 53*a*. That is, the paper passing bar 51 is housed in the housing part 61*a* of the rotating element supporter 61 through the opening 59*a* of the rotating element 59. When the paper passing bar 51 is delivered, the recess 55 is in an attitude for delivering the paper passing bar 51.

[Step S04]

The first terneplate 63*a* contacts the notch 59*c* when the rotating element 59 of the holding mechanism 45 passes through the first terneplate 63*a*, whereby the rotating element 59 rotates by 90 degrees. Here, the opening 59*a* of the rotating element 59 is directed leftward on the plane. Therefore, the opening 59*a* of the rotating element 59 is not brought into communication with the housing part 61*a*. Accordingly, the paper passing bar 51 is automatically locked so as not to drop out of the recess 55.

[Step S05]

The holding mechanism 45 moves horizontally. The opening 59*a* of the rotating element 59 is directed downward on the plane.

[Step S06]

The holding mechanism 45 moves vertically. The opening 59*a* of the rotating element 59 is directed rightward on the plane.

[Step S07]

The second terneplate 63*b* contacts the notch 59*c* when the rotating element 59 of the holding mechanism 45 passes through the second terneplate 63*b*, whereby the rotating element 59 rotates by 90 degrees. Here, the opening 59*a* of the rotating element 59 is directed in a direction opposite to the travelling direction, i.e. upward on the plane. Moreover, the opening 59*a* of the rotating element 59 is brought into communication with the housing part 61*a*. Accordingly, the paper passing bar 51 is automatically unlocked to release prevention of dropping off.

[Step S08]

When the holding mechanism 45 passes through the second delivering section 53*b*, the recess 55 of the holding mechanism 45 places the paper passing bar 51 in the second delivering section 53*b*. Here, upon delivering the paper passing bar 51, the recess 55 is in an attitude for delivering the paper passing bar 51.

[Step S09]

The holding mechanism 45 moves horizontally. The opening 59*a* of the rotating element 59 is directed leftward on the plane.

[Step S10]

The third terneplate 63*c* contacts the notch 59*c* when the rotating element 59 of the holding mechanism 45 passes through the third terneplate 63*c*, whereby the rotating element 59 rotates by 90 degrees. Here, the opening 59*a* of the rotating element 59 is directed downward on the plane. Moreover, the fourth terneplate 63*d* contacts the notch 59*c* when the rotating element 59 of the holding mechanism 45 passes through the fourth terneplate 63*d*, whereby the rotating element 59 rotates by 90 degrees. Here, the opening 59*a* of the rotating element 59 is directed in the travelling direction, i.e. rightward on the plane. Moreover, the opening 59*a* of the rotating element 59 is brought into communication with the housing part 61*a* of the rotating element supporter 61. Then, the holding mechanism 45 returns into the condition in Step S01.

As illustrated in FIG. 2, the inkjet printing station 2 is formed by the four units of the first to fourth units 2*a* to 2*d*. The operations (Step SOI to Step S10) are repeated between the units adjoining each other, whereby the paper passing bar 51 having the web paper WP attached thereto is delivered. The paper passing bar 51 is delivered to the first unit 2*a*, the second unit 2*b*, the third unit 2*c*, and the fourth unit 2*d*, in this order. Thus, the web paper WP is inserted into the inkjet printing station 2.

In this example, the inkjet printing station 2 is divided into the four units 2*a* to 2*d* depending on functions. The four units each include the chains 43 arranged along the transportation path 203 of the web paper WP. The chain 43 has the holding mechanism 45 fixed thereon. The holding mechanism 45 holds the both ends of the paper passing bar 51 to which the web paper WP is attached. As the chain 43 is driven via the handle 47, the holding mechanism 45 enables to move while being guided by the chain 43. The paper passing bar 51 is delivered between the units adjoining each other among the four units 2*a* to 2*d*. Therefore, the paper passing bar 51 is movable from one end to the other end of the inkjet printing station 2 formed by the four units 2*a* to 2*d*. This achieves readily setting of the web paper WP. Moreover, when specifications are changed for changing combination of the four units 2*a* to 2*d*, the combination can be made optionally.

Moreover, the recess 55 is rotatable relative to the axis of the paper passing bar 51. The inkjet printing apparatus 1 includes the notches 59*c* and the terneplate 63. The notches 59*c* and the terneplate 63 enable to change an attitude of the recess 55 into an attitude for delivering the paper passing bar 51 by rotation of the recess 55. Accordingly, the recess 55 enables to deliver the paper passing bar 51 smoothly.

The notches 59*c* and the terneplate 63 change the attitude of the recess 55, whereby the paper passing bar 51 is locked and unlocked automatically. Here, the paper passing bar 51 is locked for prevention from dropping off. Specifically, the opening 59*a* of the rotating element 59 is not brought into communication with the housing part 61*a* of the rotating element supporter 61, whereby the paper passing bar 51 is locked. The opening 59*a* of the rotating element 59 is brought into communication with the housing part 61*a* of the rotating element supporter 61, whereby the paper passing bar 51 is unlocked.

Moreover, the paper passing bar 51 is delivered through the delivering section 53 between the units adjoining each other (for example, the first unit 2*a* and the second unit 2*b*). Since the paper passing bar 51 placed on the delivering section 53 is delivered, the paper passing bar 51 can be delivered with more ease than the case when the paper passing bar 51 is directly delivered. In addition, the delivering section 53 enables to prevent the paper passing bar 51 from being guided to be delivered beyond the chain 43.

EXAMPLE 2

Figure 5A:
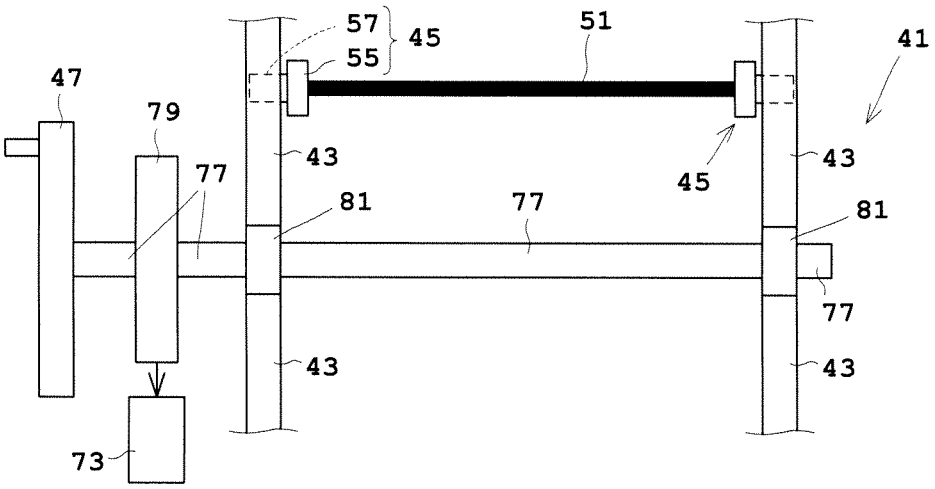
FIG. 5A illustrates a movement detecting section and around thereof according to another example of this invention.
Figure 5B:
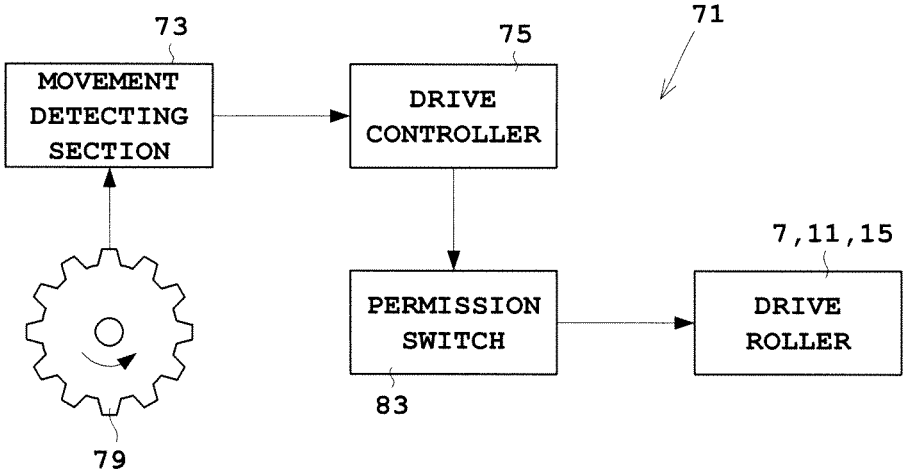
FIG. 5B is a block diagram illustrating a control system of a paper-passing assist mechanism according to the other example of this invention.
Figure 5C:
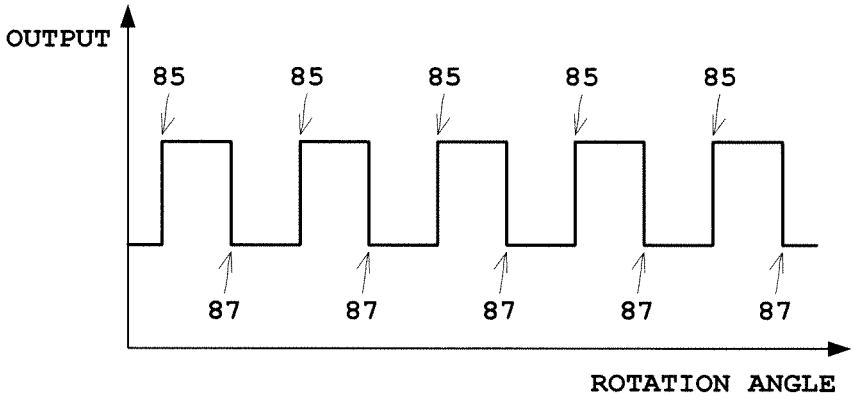
FIG. 5C illustrates one aspect of output from the movement detecting section.

Description will be given next of Example 2 with reference to the drawings. FIG. 5A illustrates a movement detecting section and around thereof according to Example 2. FIG. 5B is a block diagram illustrating a control system of a paper-passing assist mechanism. FIG. 5C illustrates one aspect of output from the movement detecting section. The description common to that of Example 1 is to be omitted.

In FIG. 2, a nip roller 23 is spaced away from the drive rollers 7 and 11 and 15 upon passing the paper. When the paper passing bar 51 passes between the drive rollers 7, 11, and 15 and the nip roller 23, the paper passing bar 51 is spaced away from the drive rollers 7, 11, and 15 and the nip roller 23. On the other hand, in order to obtain grip force, the drive rollers 7, 11, and 15 each undergo a surface treatment, such as ceramic spraying, on a surface thereof. Consequently, load increases due to friction between the web paper WP and the drive rollers 7, 11 and 15, resulting in increased driving torque of the handle 47 for driving the chain 43. Moreover, the increased load may tear the web paper WP. Then, Example 2 includes the following construction in addition to that in Example 1 in view of safety.

The inkjet printing apparatus 1 includes a paper-passing assist mechanism 71 that assists passing of the paper. The paper-passing assist mechanism 71 includes a movement detecting section 73 for detecting movement of the chain 43, drive rollers 7, 11, and 15 for transporting the web paper WP, and drive controllers 75 for controlling the drive rollers 7, 11, and 15.

Reference is now made to FIG. 5. The handle 47 of the paper passing mechanism 41 has a fixed shaft 77 at a tip end thereof. A rotor plate 79 is fixed on the shaft 77. The shaft 77 has sprockets 81 fixed thereon for engaging with two chains 43.

The movement detecting section 73 detects movement of the chain 43 by detecting a rotation amount of the rotor plate 79. The rotor plate 79 is formed of a gear, a rotary encoder, and the like. The movement detecting section 73 is formed of a magnetic sensor, an optical sensor with light emitting elements and light receiving elements, and the like. A drive controller 75 (FIG. 5B) drives the drive rollers 7, 11, and 15 in accordance with the movement detected by the movement detecting section 73.

The inkjet printing station 2 is covered with a housing (not shown). When operation is conducted within the housing, a door provided in the housing is opened. In this case, an interlock mechanism is usually provided in view of safety so as not to drive the drive rollers 7, 11, and 15. Consequently, the inkjet printing apparatus 1 includes a permission switch 83 for permitting drive of the drive rollers 7, 11, and 15, as illustrated in FIG. 5B. The permission switch 83 turns from an OFF state of prohibiting the drive into an ON state of permitting the drive. Accordingly, the drive rollers 7, 11, and 15 enable to drive in accordance with the movement detected by the movement detecting section 73. The permission switches 83 may be provided for different four units 2*a* to 2*d*.

Description will be given next of operation of the paper-passing assist mechanism 71 with reference to FIG. 5B and FIG. 5C. An operator rotates the handle 47. As the handle 47 rotates, the rotor plate 79 also rotates. When the movement detecting section 73 detects a rotation amount of the rotor plate 79, thereby detecting the movement of the chain 43. Specifically, the movement detecting section 73 detects presence of cogs of the gear (rotor plate 79) illustrated in FIG. 5B, for example, with a magnetic sensor, an optical sensor, and the like. FIG. 5C illustrates one aspect of output indicating presence of the cogs detected by the movement detecting section 73.

As illustrated in FIG. 5C, square-wave output is obtained. The drive controller 75 detects rising edges 85 of the wave and generates a driving pulse of the drive rollers 7, 11, and 15. Then the drive controller 75 performs inching for driving the drive rollers 7, 11, and 15 fractionally. Accordingly, the drive controller 75 enables to drive the drive rollers 7, 11 and 15 in accordance with the movement detected by the movement detecting section 73. Alternatively, the drive controller 75 may detect falling edges 87 of the wave. That is, the drive controller 75 detects variation portions of the wave. Moreover, the drive controller 75 does not need to match the movement (the amount of rotation) by the drive rollers 7, 11, and 15 with the movement of the chain 43.

The drive controller 75 drives the drive rollers 7, 11, and 15 in accordance with the movement of the chain 43. However, the drive rollers fail to be driven in this condition. An operator turns the permission switch 83 from the OFF state of prohibiting the drive into the ON state of permitting the drive, thereby permits the drive rollers 7, 11, and 15 to drive. Specifically, the operator rotates the handle 47 by one hand, and pushes the permission switch 83 by the other hand. Accordingly, the operator is prevented from putting the operator's hand into the inkjet printing station 2, resulting in safe operation for passing the paper.

In this example, the inkjet printing apparatus 1 includes the movement detecting section 73 for detecting movement of the chain 43, the drive rollers 7, 11, and 15 for transporting the web paper WP, and the drive rollers 75 for controlling the drive rollers 7, 11, and 15 in accordance with the movement detected by the movement detecting section 73. As the chain 43 is driven by the handle 47, the movement detecting section 73 detects the movement of the chain 43. The drive controller 75 drives the drive rollers 7, 11, and 15 in accordance with the movement detected by the movement detecting section 73. Accordingly, load due to friction between the web paper WP and the drive rollers 7, 11, and 15 can be reduced upon passing the paper. Therefore, driving torque of the handle 47 for driving the chain 43 can be reduced. In addition, tearing of the paper of the web paper WP can be eliminated.

The inkjet printing apparatus 1 includes the permission switch 83 for permitting drive of the drive rollers 7, 11, and 15. The drive controller 75 drives the drive rollers 7, 11, and 15 in accordance with the movement detected by the movement detecting section 73. The permission switch 83 enables to prevent the drive rollers 7, 11, and 15 from driving unexpectedly, resulting in safe paper passing by the operator.

This invention is not limited to the foregoing examples, but may be modified as follows.

(1) In each of the foregoing examples, the inkjet printing station 2 includes the four units, i.e., the first to fourth units 2*a* 2*d*. The units may be combined optionally. For instance, the inkjet printing station 2 may be formed by three units (i.e., the first unit 2*a*, the second unit 2*c*, and the fourth unit 2*d*). That is, the print unit 17 is formed individually. Where printing with high definition is not needed, the one print unit 17 includes four inkjet heads 25 of KCMY. Moreover, three or more print units may be adopted.

The inkjet printing station 2 may include a unit, instead of the fourth unit 2*d*, having another function. For instance, the drying section 19 may be replaced with one having different dry powers in accordance with the number of the print unit.

(2) In each of the foregoing examples and modification (1), the paper passing mechanism 41 includes the chains 43. However, this is not limitative. For instance, a belt with cogs that does not slip may be used as the endless belt. That is, it is preferable that the endless belts synchronously move between front and back sides on the plane of FIG. 2 or between the units adjoining each other. Moreover, the endless belt may be formed of a V-belt, a wire, and others occasionally. When the endless belt is formed of the belt with cogs, the V-belt, the wire, and others, the sprocket 49 is formed of a roller such as a pulley.

Figure 6:
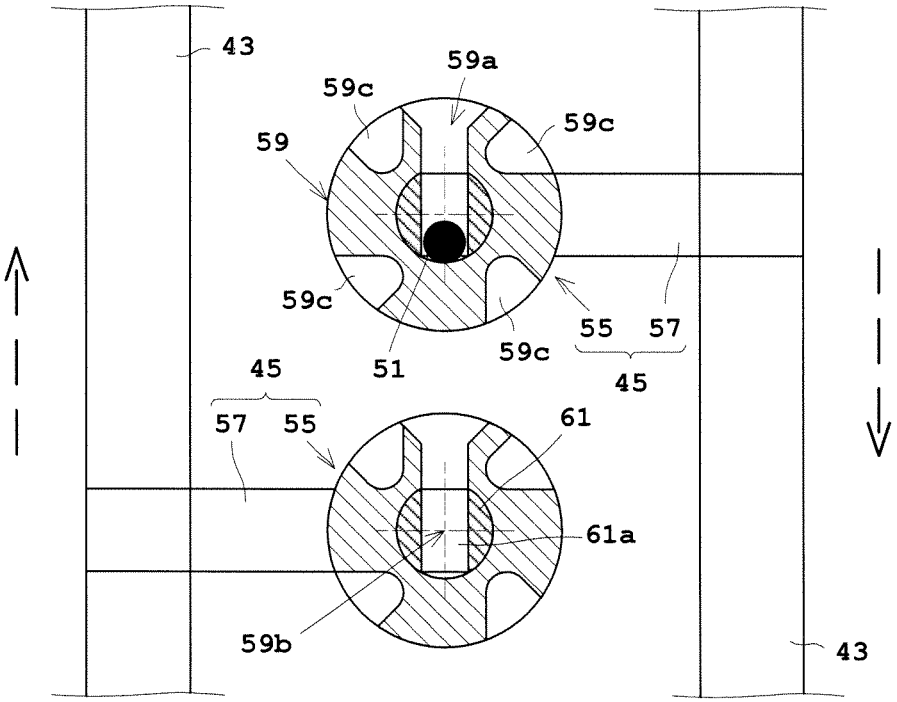
FIG. 6 is an explanatory view illustrating operation of delivering a paper passing bar directly between holding mechanisms according to one modification of this invention.

(3) In each of the foregoing examples and modifications, the four units 2*a* to 2*d* of the inkjet printing apparatus 1 deliver the paper passing bar 51 between the units adjoining each other via the delivering section 53. Alternatively, in the four units 2*a* to 2*d*, the holding mechanism 45*s* between the adjoining units may deliver the paper passing bar 51 directly. As illustrated in FIG. 6, the holding mechanisms 45 between the adjoining units directly deliver the paper passing bar 51 with no interference. The holding mechanisms 45 between the adjoining units drive synchronously such that the paper passing bar 51 is delivered at a position and a region set in advance. Accordingly, no delivering section 53 is provided, resulting in an effect due to no delivering section 53 such as obtaining a usable space where the delivering section 53 is to be placed originally.

(4) In each of the foregoing examples and modifications, the inkjet printing apparatus has been described as one example of the printing apparatus. Alternatively, the printing apparatus may be one such as a rotary press used for offset printing or gravure printing and the like. For instance, this invention is applicable to a rotary press divided into two or more units.

(5) In each of the foregoing examples and modifications, the chain 43 is driven with the handle 47. Alternatively, the chain 43 may be driven with a drive mechanism such as a motor. The drive mechanism such as a motor corresponds to the endless-belt driving mechanism in this invention.

This invention may be embodied in other specific forms without departing from the spirit or essential attributes thereof and, accordingly, reference should be made to the appended claims, rather than to the foregoing specification, as indicating the scope of the invention.

What is claimed is:

1. A printing apparatus for performing printing to a print medium supplied from a roll of the print medium, comprising:

two or more units formed by dividing a printing apparatus body depending on functions;

an endless belt provided for each of the two or more units and disposed along a transportation path of the print medium;

a holding mechanism fixedly arranged on the endless belt for holding both ends of an attachment bar to which the print medium is attached; and an endless-belt driving mechanism for driving the endless belt, the two or more units delivering the attachment bar between the units adjoining each other.

2. The apparatus according to claim 1, wherein the holding mechanism includes a recess for holding the both ends of the attachment bar.

3. The apparatus according to claim 2, wherein the recess includes a locking mechanism for preventing the attachment bar from dropping off.

4. The apparatus according to claim 3, further comprising:

an attitude changing section for changing an attitude of the recess into an attitude for delivering the attachment bar by rotation of the recess, the recess being rotatable relative to an axis of the attachment bar.

5. The apparatus according to claim 4, wherein the two or more units deliver the attachment bar via a delivering section between the units adjoining each other.

6. The apparatus according to claim 2, further comprising:

an attitude changing section for changing an attitude of the recess into an attitude for delivering the attachment bar by rotation of the recess, the recess being rotatable relative to an axis of the attachment bar.

7. The apparatus according to claim 6, wherein the two or more units deliver the attachment bar via a delivering section between the units adjoining each other.

8. The apparatus according to claim 2, wherein the two or more units deliver the attachment bar via a delivering section between the units adjoining each other.

9. The apparatus according to claim 6, wherein the two or more units deliver the attachment bar directly via the holding mechanisms between the units adjoining each other.

10. The apparatus according to claim 6, further comprising:

a movement detecting section for detecting movement of the endless belt;

a drive roller for transporting the print medium; and a drive controller for driving the drive roller in accordance with the movement detected by the movement detecting section.

11. The apparatus according to claim 1, wherein the two or more units deliver the attachment bar via a delivering section between the units adjoining each other.

12. The apparatus according to claim 1, wherein the two or more units deliver the attachment bar directly via the holding mechanisms between the units adjoining each other.

13. The apparatus according to claim 1, further comprising:

a movement detecting section for detecting movement of the endless belt;

a drive roller for transporting the print medium; and a drive controller for driving the drive roller in accordance with the movement detected by the movement detecting section.

14. The apparatus according to claim 13, further comprising:

a permission switch for permitting drive of the drive roller.

15. The apparatus according to claim 2, wherein the two or more units deliver the attachment bar directly via the holding mechanisms between the units adjoining each other.

16. The apparatus according to claim 2, further comprising:

a movement detecting section for detecting movement of the endless belt;

a drive roller for transporting the print medium; and a drive controller for driving the drive roller in accordance with the movement detected by the movement detecting section.

17. The apparatus according to claim 3, wherein the two or more units deliver the attachment bar via a delivering section between the units adjoining each other.

18. The apparatus according to claim 3, further comprising:

a movement detecting section for detecting movement of the endless belt;

a drive roller for transporting the print medium; and a drive controller for driving the drive roller in accordance with the movement detected by the movement detecting section.

19. The apparatus according to claim 3, wherein the two or more units deliver the attachment bar directly via the holding mechanisms between the units adjoining each other.

20. The apparatus according to claim 4, wherein the two or more units deliver the attachment bar directly via the holding mechanisms between the units adjoining each other.

* * * * *